US007409185B2

(12) United States Patent
Terao et al.

(10) Patent No.: US 7,409,185 B2
(45) Date of Patent: Aug. 5, 2008

(54) SHEET POST-PROCESS APPARATUS AND WAITING TRAY

(75) Inventors: Yasunobu Terao, Tagata-gun (JP); Yoshiaki Sugizaki, Sunto-gun (JP); Mikio Yamamoto, Tagata-gun (JP); Tomomi Iijima, Mishima (JP); Hiroyuki Taki, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 115 days.

(21) Appl. No.: 11/008,248

(22) Filed: Dec. 10, 2004

(65) Prior Publication Data

US 2006/0067770 A1 Mar. 30, 2006

(30) Foreign Application Priority Data

Sep. 28, 2004 (JP) ..... 2004-281773

(51) Int. Cl.
*G03G 15/00* (2006.01)

(52) U.S. Cl. ..... 399/405; 399/407

(58) Field of Classification Search ..... 399/405, 399/407, 408, 410; 270/58.09
See application file for complete search history.

(56) References Cited

U.S. PATENT DOCUMENTS

| | | | | |
|---|---|---|---|---|
| 4,473,425 | A | | 9/1984 | Baughman et al. |
| 4,611,741 | A | | 9/1986 | Wilson |
| 4,667,208 | A | | 5/1987 | Shiraki et al. |
| 4,794,859 | A | | 1/1989 | Huseby et al. |
| 4,849,796 | A | * | 7/1989 | Murakami ..... 399/21 |
| 4,878,656 | A | | 11/1989 | Honjo et al. |
| 4,898,374 | A | | 2/1990 | Vermaat |
| 4,917,366 | A | | 4/1990 | Murakami et al. |
| 5,021,837 | A | | 6/1991 | Uto et al. |
| 5,098,074 | A | | 3/1992 | Mandel et al. |
| 5,282,611 | A | | 2/1994 | Ueda et al. |
| 5,285,249 | A | | 2/1994 | Mahoney |
| 5,289,251 | A | | 2/1994 | Mandel et al. |
| 5,337,134 | A | | 8/1994 | Sato et al. |
| 5,418,606 | A | | 5/1995 | Kikuchi et al. |
| 5,435,544 | A | | 7/1995 | Mandel |
| 5,451,037 | A | | 9/1995 | Lundstrom |
| 5,590,871 | A | | 1/1997 | Okabe et al. |

(Continued)

FOREIGN PATENT DOCUMENTS

JP 61-078162 U 5/1986

(Continued)

OTHER PUBLICATIONS

U.S. Appl. No. 11/085,226, filed Mar. 22, 2005, Terao et al.

(Continued)

*Primary Examiner*—Anthoy H. Nguyen
(74) *Attorney, Agent, or Firm*—Foley & Lardner LLP

(57) ABSTRACT

A sheet processing apparatus is featured in that a waiting tray comprises an extensible tray set to enable projection of a transported sheet in a distal end direction and retraction into a distal end direction, wherein, in the case where a size of a sheet transported to the waiting tray exceeds a size set on the waiting tray, an extensible tray drive roller is driven to project the extensible tray in a transport proximal end direction of the sheet.

4 Claims, 14 Drawing Sheets

U.S. PATENT DOCUMENTS

| | | | |
|---|---|---|---|
| 5,622,359 | A | 4/1997 | Kawano et al. |
| 5,628,502 | A | 5/1997 | Amarakoon |
| 5,640,232 | A | 6/1997 | Miyake et al. |
| 5,676,517 | A | 10/1997 | Lotz |
| 5,709,376 | A | 1/1998 | Ushirogata |
| 5,767,884 | A | 6/1998 | Bortolotti et al. |
| 5,934,140 | A | 8/1999 | Jackson et al. |
| 5,961,274 | A | 10/1999 | Bors |
| 5,971,384 | A | 10/1999 | Asao |
| 6,065,747 | A | 5/2000 | Khovaylo et al. |
| 6,092,948 | A | 7/2000 | Altfather |
| 6,120,020 | A | 9/2000 | Asao |
| 6,142,461 | A | 11/2000 | Asao et al. |
| 6,145,828 | A | 11/2000 | Arai |
| 6,146,085 | A | 11/2000 | Namba et al. |
| 6,179,287 | B1 | 1/2001 | Watanabe et al. |
| 6,231,039 | B1 | 5/2001 | Chung |
| 6,330,999 | B2 | 12/2001 | Coombs et al. |
| 6,336,630 | B1 | 1/2002 | Holtman et al. |
| 6,354,059 | B1 | 3/2002 | Yoshie et al. |
| 6,357,753 | B1 | 3/2002 | Yamasaki et al. |
| 6,450,934 | B1 | 9/2002 | Coombs |
| 6,581,922 | B2 | 6/2003 | Kuwata et al. |
| 6,641,129 | B2 | 11/2003 | Ogita et al. |
| 6,659,455 | B2 | 12/2003 | Endo et al. |
| 6,671,492 | B2 | 12/2003 | Mimura et al. |
| 6,698,744 | B2 | 3/2004 | Yamada et al. |
| 6,712,349 | B2 | 3/2004 | Watanabe |
| 6,722,646 | B2 | 4/2004 | Sekiyama et al. |
| 6,722,650 | B1 | 4/2004 | Abbata et al. |
| 6,733,006 | B2 | 5/2004 | Kobayashi et al. |
| 6,733,007 | B2 | 5/2004 | Sekiyama et al. |
| 6,767,012 | B2 | 7/2004 | Sasamoto |
| 6,819,906 | B1 | 11/2004 | Herrmann et al. |
| 6,824,128 | B2 | 11/2004 | Nagata et al. |
| 6,871,042 | B2 | 3/2005 | Nemura et al. |
| 6,910,686 | B2 | 6/2005 | Awano |
| 6,928,259 | B2 | 8/2005 | Sakuma |
| 6,988,728 | B2 | 1/2006 | Kida |
| 2002/0047233 | A1 | 4/2002 | Coombs et al. |
| 2002/0053766 | A1 | 5/2002 | Kubota |
| 2002/0163119 | A1 | 11/2002 | Kawata |
| 2003/0057625 | A1 | 3/2003 | Kuwata et al. |
| 2004/0113348 | A1 | 6/2004 | Awano |
| 2004/0126163 | A1 | 7/2004 | Asami et al. |
| 2004/0181308 | A1 | 9/2004 | Hayashi et al. |
| 2005/0000336 | A1 | 1/2005 | Hattori et al. |

FOREIGN PATENT DOCUMENTS

| | | | |
|---|---|---|---|
| JP | 61-108588 | A | 5/1986 |
| JP | 61-021481 | Y2 | 6/1986 |
| JP | 62-229126 | A | 10/1987 |
| JP | 63-035756 | U | 3/1988 |
| JP | 63-180673 | A | 7/1988 |
| JP | 02-055369 | A | 2/1990 |
| JP | 03-088667 | A | 4/1991 |
| JP | 04-079857 | U | 7/1992 |
| JP | 04-312894 | A | 11/1992 |
| JP | 04-354756 | A | 12/1992 |
| JP | 05-238103 | A | 9/1993 |
| JP | 06-064815 | A | 3/1994 |
| JP | 06-094324 | B2 | 11/1994 |
| JP | 08-026558 | A | 1/1996 |
| JP | 08-259073 | A | 10/1996 |
| JP | 2583594 | B2 | 11/1996 |
| JP | 09-309659 | A | 12/1997 |
| JP | 10-095563 | A | 4/1998 |
| JP | 10-279169 | A | 10/1998 |
| JP | 10-324449 | A | 12/1998 |
| JP | 11-011786 | A | 1/1999 |
| JP | 11-043257 | A | 2/1999 |
| JP | 11-147641 | A | 6/1999 |
| JP | 11-157729 | A | 6/1999 |
| JP | 11-208967 | A | 8/1999 |
| JP | 11-231753 | A | 8/1999 |
| JP | 11-301912 | A | 11/1999 |
| JP | 2000-095420 | A | 4/2000 |
| JP | 2000-159414 | A | 6/2000 |
| JP | 2001-048411 | A | 2/2001 |
| JP | 2001-72321 | A | 3/2001 |
| JP | 2001-089009 | A | 4/2001 |
| JP | 2001-316029 | A | 11/2001 |
| JP | 2002-060118 | A | 2/2002 |
| JP | 2002-308509 | A | 10/2002 |
| JP | 2002-321862 | A | 11/2002 |
| JP | 2002-362825 | A | 12/2002 |
| JP | 2003-081517 | A | 3/2003 |
| JP | 2003-171057 | A | 6/2003 |
| JP | 2003-192210 | A | 7/2003 |
| JP | 2003-246536 | A | 9/2003 |
| JP | 2003-335450 | A | 11/2003 |
| JP | 2004-142868 | A | 5/2004 |

OTHER PUBLICATIONS

U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
U.S. Appl. No. 11/008,122, filed Dec. 10, 2004, Sasahara.
U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.

* cited by examiner

SHEET POST-PROCESS APPARATUS AND WAITING TRAY

CROSS-REFERENCE TO RELATED APPLICATIONS

This application is based upon and claims the benefit of priority from prior Japanese Patent Application No. 2004-281773, filed Sep. 28, 2004, the entire contents of which are incorporated herein by reference.

BACKGROUND OF THE INVENTION

1. Field of the Invention

The present invention relates to an apparatus (finisher) for bundling sheets sent from an image forming apparatus, thereby carrying out, for example, staple processing and a waiting tray for use in the post-process apparatus.

2. Description of the Related Art

A post-process apparatus comprises: a processing tray for bundling sheets sent from an image forming apparatus, thereby carrying out, for example, staple processing, and ejecting the processed bundles of sheets; and a storage tray for holding the ejected bundles of sheets. A staple processing speed of the post-process apparatus is slow as compared with an image processing speed of the image forming apparatus. Thus, if a sheet is directly sent to the processing tray, a sheet to be staple processed next is transported while a preceding sheet is staple processed. In order to prevent this problem, conventionally, a buffer mechanism for adjusting a carrying-in timing of a sheet at a front stage of the processing tray is proposed.

Japanese Patent Document 1: Japanese Patent No. 2583594 discloses a mechanism for retaining sheets is provided at a transport passage for sending sheets sent from an image forming apparatus to a processing tray. However, in this case, there is a need for increasing the transport passage in length, and, as a result, the post-process apparatus is likely to be large in size.

Japanese Patent document 2: Jpn. Pat. Appln. KOKAI Publication No. 2000-72321 discloses a mechanism that an extension tray is retractably provided on a sheet alignment tray of a staple unit; and, when a recorded sheet is ejected from an image forming apparatus, the extension tray is fed out from the sheet alignment tray, and the ejected sheets are stacked on these trays. However, the patent document 2 discloses a technique relating to the sheet alignment tray of the staple unit which is technically different from that of the present invention relating to a waiting tray. Therefore, advantageous effect of the present invention cannot be attained.

BRIEF SUMMARY OF THE INVENTION

The Inventors proposes here that a waiting tray is newly allocated as a buffer mechanism at an upper stage of a processing tray. The waiting tray according to this proposal is allocated to be proximal to the upper stage of the processing tray, and a sheet transported from an image forming apparatus to the processing tray is temporarily retained here in a waiting mode. At a time point when retention in a waiting mode is released, that is, at a time point when staple processing of a bundle of sheets at the processing tray terminates, and then, the bundle of sheets is transported from the processing tray to a storage tray, the sheet is supported on a bottom face of the waiting tray. By opening this tray, the sheet is then dropped at the distal end side (upstream side when the sheet is transported to the waiting tray) to the processing tray. By using this waiting tray, equipment can be allocated with a simple mechanism without a need to increase a transport passage in length and providing a space. As a result, a post-process apparatus can be made compact. Moreover, it is possible to sent the sheets to the processing tray without any malfunction.

However, when a sheet support face of the waiting tray is released (when a sheet is dropped onto the processing tray), the sheet is pulled to either of the left and right sheet support faces. Thus, there is a danger that the sheet is dropped onto the processing tray while it is shifted in its widthwise direction (in a transverse direction when the sheet transport direction is defined as a longitudinal direction). In order to solve the above described problem, the present invention comprises the following features.

1. A sheet post-process apparatus, the apparatus comprising:

a waiting tray which temporarily retains a transported sheet in a waiting mode, and releases the retention to drop the sheet;

a processing tray which bundles sheets dropped from the waiting tray to carry out predetermined processing, and ejects the sheets; and a storage tray which holds the bundle of sheets processed and ejected on the processing tray, wherein the waiting tray comprises:

left and right lower face support members which support left and right lower faces in a sheet transport direction during retention in a waiting mode and release the support of the left and right lower faces during release of the retention;

an extensible tray housed in the left and right lower face support members, the extensible tray being projectively provided in a proximal end direction of the transported sheet;

drive means for projecting the extensible tray in a transport distal end direction of the sheet; and control means for controlling the drive means, and the control means controls the drive means to project the extensible tray in the transport proximal end direction of the sheet when it is sensed that a size of a sheet transported to the waiting tray exceeds a size set on the waiting tray, based on information concerning a size of the sheet transported to thez waiting tray.

2. A sheet post-process apparatus according to 1, further comprising sensor means for sensing height of sheets held on the waiting tray, wherein the control means controls the drive means to adjust a projection length of the extensible tray, based on the height of sheets sensed by the sensor means.

3. A sheet post-process apparatus according to 1, wherein the waiting tray is allocated to be proximal to an upper stage of the processing tray, the processing tray and the waiting tray are allocated in an inclined shape which is high at a proximal end side of the sheet to be transported and which is low at a distal end side thereof, the processing tray and the waiting tray are shorter in length of a sheet transport direction thereof than a length of a standard sheet to be held, and a part of the proximal end side in the transport direction of the sheet held on the processing tray is held on the storage tray.

4. A waiting tray for use in a sheet post-process apparatus, for temporarily retaining a transported sheet in a waiting mode, followed by releasing the support, making it possible to drop the sheet on a processing tray, the waiting tray comprising:

left and right lower face support members which support left and right lower faces in a sheet transport direction during retention in a waiting mode and release the support of the left and right lower faces during release of the retention; and an extensible tray housed in the left and right lower face support members, the extensible tray being projectively provided on a proximal end direction of the transported sheet.

5. A sheet post-process apparatus, the apparatus comprising:

waiting means for temporarily retaining a transported sheet in a waiting mode, and releasing the retention to drop the sheet;

processing means for bundling sheets dropped from the waiting means to carry out predetermined processing, and ejecting the sheets; and storage means for holding the bundle of sheets processed and ejected by the processing means, wherein the waiting means comprises:

left and right lower face support means for supporting left and right lower faces in a sheet transport direction during retention in a waiting mode and releasing the support of the left and right lower faces during release of the retention;

extensible means housed in the left and right lower face support means, the extensible means being projectively provided in a proximal end direction of the transported sheet;

drive means for projecting the extensible means in a transport distal end direction of the sheet; and control means for controlling the drive means, and the control means controls the drive means to project the extensible tray in the transport proximal end direction of the sheet when it is sensed that a size of the sheet transported to the waiting tray exceeds a size set on the waiting means, based on information concerning a size of the sheet transported to the waiting tray.

In the present specification and claims, a proximal end side, a distal end side, and a sheet width are defined as follows. That is, when a transport direction of a sheet to be transported to a waiting tray is defined as a reference, a downstream side in the transport direction is defined as a proximal end side; an upstream side in the transport direction is defined as a distal end side; and a length in a transverse direction when the sheet transport direction is defined as a longitudinal direction is defined as a sheet width. In addition, a sheet denotes a copy sheet on which a toner image (developed image) is copied and which is sent from the image forming apparatus.

According to the present invention, the waiting tray is formed in size (length) which corresponds to a sheet of size which is frequently used (for example, A4 side). However, when it is sensed that a sheet of size which is larger (longer) than a set size (for example, A3 size), an extensible tray stored in the waiting tray is projected at its proximal end side. In this manner, the sheet of larger size can be stably retained. In addition, an extension quantity of the extensible tray is adjusted according to the height of the sheets held on the waiting tray (or the number of sheets), whereby the sheets can be stably retained in a waiting mode. Further, when a storage tray is not moved, the extensible tray can be projected.

DETAILED DESCRIPTION OF THE INVENTION

Now, one embodiment of the present invention will be described here.

(General Description of Image Forming Apparatus)

Figure 18:
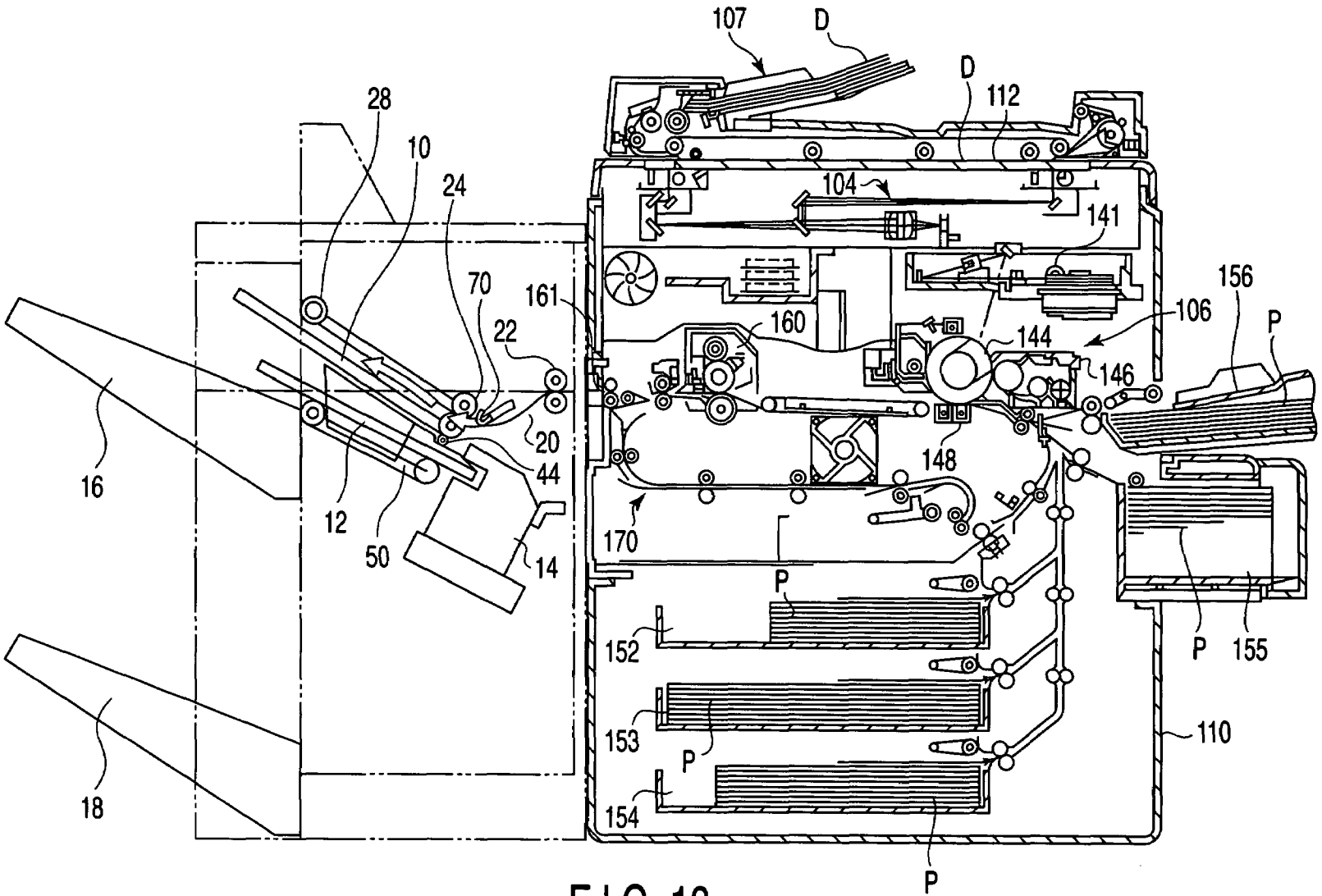
FIG. 18 is a view showing a combination of the post-process apparatus and the image forming apparatus according to the present invention.

A general description of an image forming apparatus (digital copying machine) allocated at a front stage of a post-process apparatus according to the present invention will be given with reference to FIG. 18. A manuscript placement base 112 is provided at an upper face of this apparatus. An auto document feeder 117 (hereinafter, referred to as an ADF) for automatically feeding a document D onto the manuscript placement base 112 is allocated on the manuscript placement base. The manuscript D is placed on the ADF, predetermined settings (such as the presence of absence of staple processing, how to carry out staple processing, the number of copies, or size of sheet to be copied, for example), and then, a copy start button is pressed. The manuscript D on the ADF is transported to a predetermined location of the manuscript placement base 112.

A scanner unit 4, a printer unit 6, and a copy sheet cassette and feeder are arranged at the inside of the image forming apparatus. At the scanner unit 4, the manuscript D on the manuscript placement base 112 is scanned, and reflection light thereof is incident. The incident reflection light is converted in a photoelectric manner, image information on the manuscript D is read, and a photoelectric signal corresponding to the read image information is output. At the printer unit 6, according to the image information or the like on the manuscript D read by the scanner unit 4, an electrostatic latent image is formed on a peripheral face of a photosensitive drum 144 by a semiconductor laser 141. Then, a toner is supplied from a developing device 146 to the photosensitive drum 144; the electrostatic latent image formed on the photosensitive drum 144 is substantially produced, and a tone image is formed.

To this photosensitive drum 144, a copy sheet P is sent from cassettes 52, 53, 54, and 56 or a feeder 55 of the copy sheet P, and the toner image on the photosensitive drum 144 is copied onto the copy sheet by a transfer charger 148. Then, the toner image of the copy sheet is fixed by a fixing device 160, and the fixed toner image is ejected from an ejection port 161. This sheet comes under the sheet of the present specification and claims.

In a control circuit of the image forming apparatus side, information concerning a sheet such as sheet size, the presence or absence of sort, or the presence or absence of staple processing is entered by operator's data input and/or an input signal from sensor means provided in the image forming apparatus. The control circuit at the image forming apparatus side sends information concerning a sheet transported to the control circuit of the post-process apparatus side based on these items of information. The information includes the following. For example, the sheet is provided as a sheet retained in the waiting tray in a waiting mode, the sheet being a sheet other than a last sheet to be held. The sheet is provided as a sheet retained in the standby sheet in a waiting mode, the sheet being a last sheet to be held. The sheet is provided as a sheet retained in the waiting tray in a waiting mode (a sheet being directly dropped on the processing sheet). The sheet is provided as a sheet being directly ejected to the storage tray without being dropped on the waiting tray. Information concerning dimensions of a sheet to be transported to the post-process apparatus (such as A3 or A4 size, for example) or sheet length (such as ordinary paper or a variety of cardboards, for example) is also sent from a control circuit at the image forming apparatus side to a control circuit at the post-process apparatus side.

Information concerning a length of a sheet which is larger than that of a set sheet is sensed by a sensor provided in the post-process apparatus. The sensed information is sent from this sensor to the control circuit at the post-process apparatus side.

(General Description of Post-Process Apparatus)

A general description of the post-process apparatus will be given with reference to FIG. 18. The post-process apparatus is provided as an apparatus for bundling sheets 20 transported from an image forming apparatus, thereby carrying out staple processing or the like. This post-process apparatus is allocated in contact with the ejection port 161 of the image forming apparatus. That is, a sheet transport inlet is provided in association with the ejection port 161 of the image forming apparatus, and an inlet roller 22 is allocated in this sheet transport inlet. The inlet roller 22 introduces the sheets 20 into a paper pass ceiling 36 for forming a transport passage in the post-process apparatus (refer to FIG. 1). This paper pass ceiling 36 guides a sheet to a waiting tray 10 and a processing tray 12. Two storage trays 16 and 18 are allocated at the downstream side of the processing tray 12 (at the downstream side of the waiting tray 10).

The waiting tray 10 is allocated to be proximal to the upper stage of the processing tray 12 while the waiting tray is inclined so as to be upward at the proximal end side of the sheet to be transported and so as to be downward at the distal end side. A paper feed roller 24 is provided at the distal end side of this waiting tray 10 (at the upstream side of the sheet to be transported), and a waiting tray roller 28 is provided at the proximal end side of the tray (at the downstream side of the sheet to be transported). A sheet sensor 70 is provided at the transport inlet of the paper feed roller 24. This sensor senses a proximal end and a distal end of the sheet to be transported.

The processing tray 12 is allocated at the lower stage of the processing tray 12 while the processing tray is inclined so as to be upward at the proximal end side of the sheet (at the downward side of the sheet to be transported to the storage tray) and so as to be downward at the distal end side (upstream side of the sheet to be transported to the ejected paper storage tray). A stapler 14 is provided at the distal end side of the processing tray 12. A transport mechanism 50 is provided on the processing tray 12 so as to transport a bundle of staple processed sheets or the like to the storage tray 16 or 18.

Here, in the post-process apparatus according to the present invention, the waiting tray 10 and the processing try 12 both are small in size, as compared with the size of sheet to be transported in order to make equipment compact. Since the waiting tray 12 is small in size than a sheet to be held thereon, when a sheet is dropped from the waiting tray 10 to the processing tray 12, that sheet is held across the processing tray 12 and the storage tray 16 (or 18) (refer to FIGS. 10 to 13).

A control circuit of the post-process apparatus controls the waiting tray 10 to make a proper operation based on information concerning a sheet obtained from the control circuit at the image forming apparatus side and information available from the sheet sensor 70.

For example, when a sheet transported to the waiting tray is provided as a sheet which should be retained on the waiting tray in a waiting mode, the sheet being a sheet other than a last sheet to be held, this sheet is kept to be held in a proper location of the waiting tray.

When the above sheet is provided as a sheet to be retained on the standby sheet in a waiting mode, the sheet being a last sheet to be held, that sheet is aligned in a proper location, and is dropped on the processing tray together with the sheet which has been held in advance on the waiting tray.

When the sheet is provided as a sheet which is not required to be retained on the waiting tray in a waiting mode, that sheet is directly dropped on the processing tray.

When the sheet is provided as a sheet to be directly ejected on the storage tray without being dropped on the processing tray, that sheet is directly transported from the waiting tray to the storage tray without intervening the processing tray.

When the sheet is provided as a sheet which is larger than a set sheet (for example, a sheet of A3 in size), the waiting tray is increased in length by expanding it.

<Waiting Tray>

Figure 1:
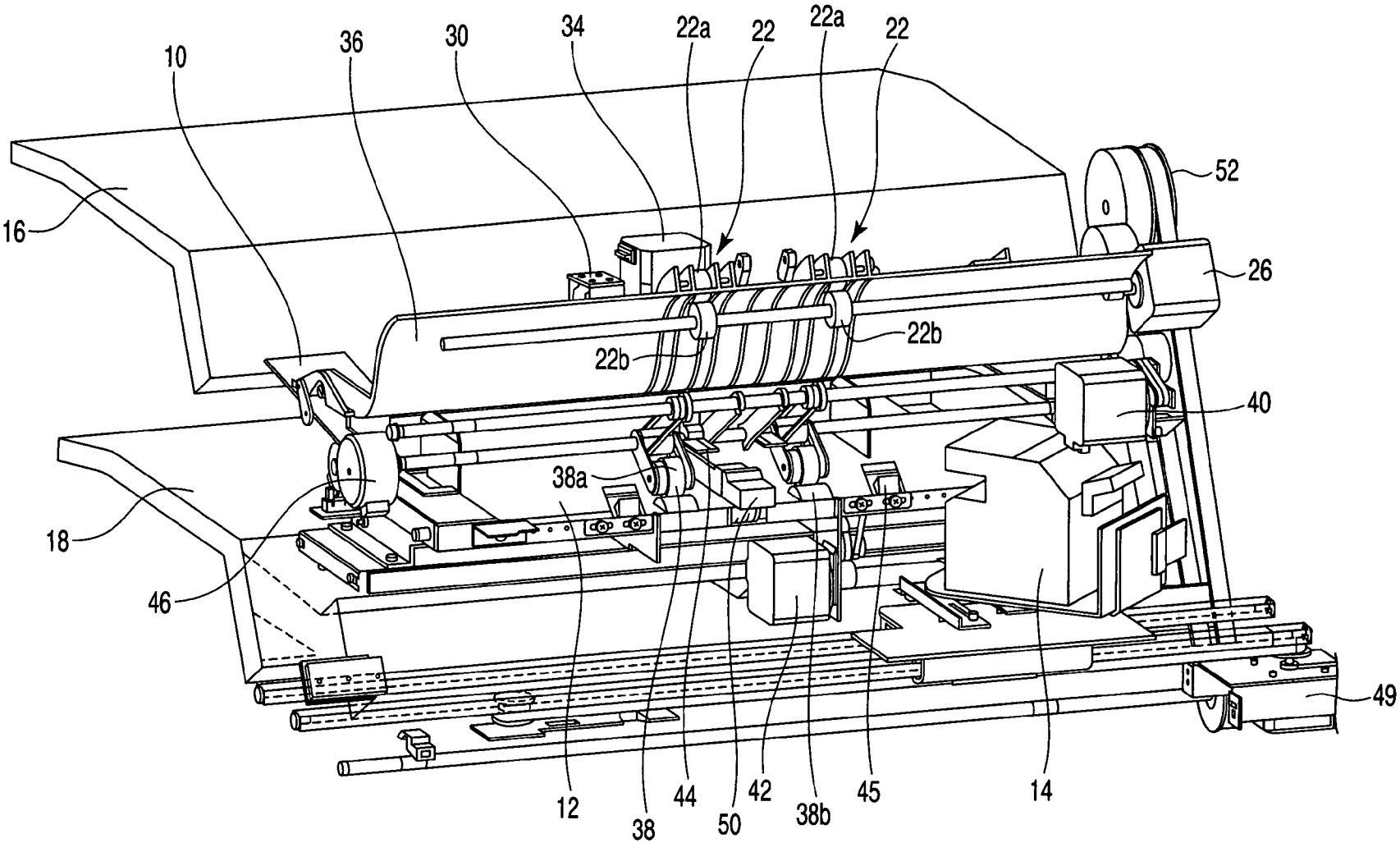
FIG. 1 is a perspective view of a post-process apparatus showing one embodiment of the present invention.
Figure 2:
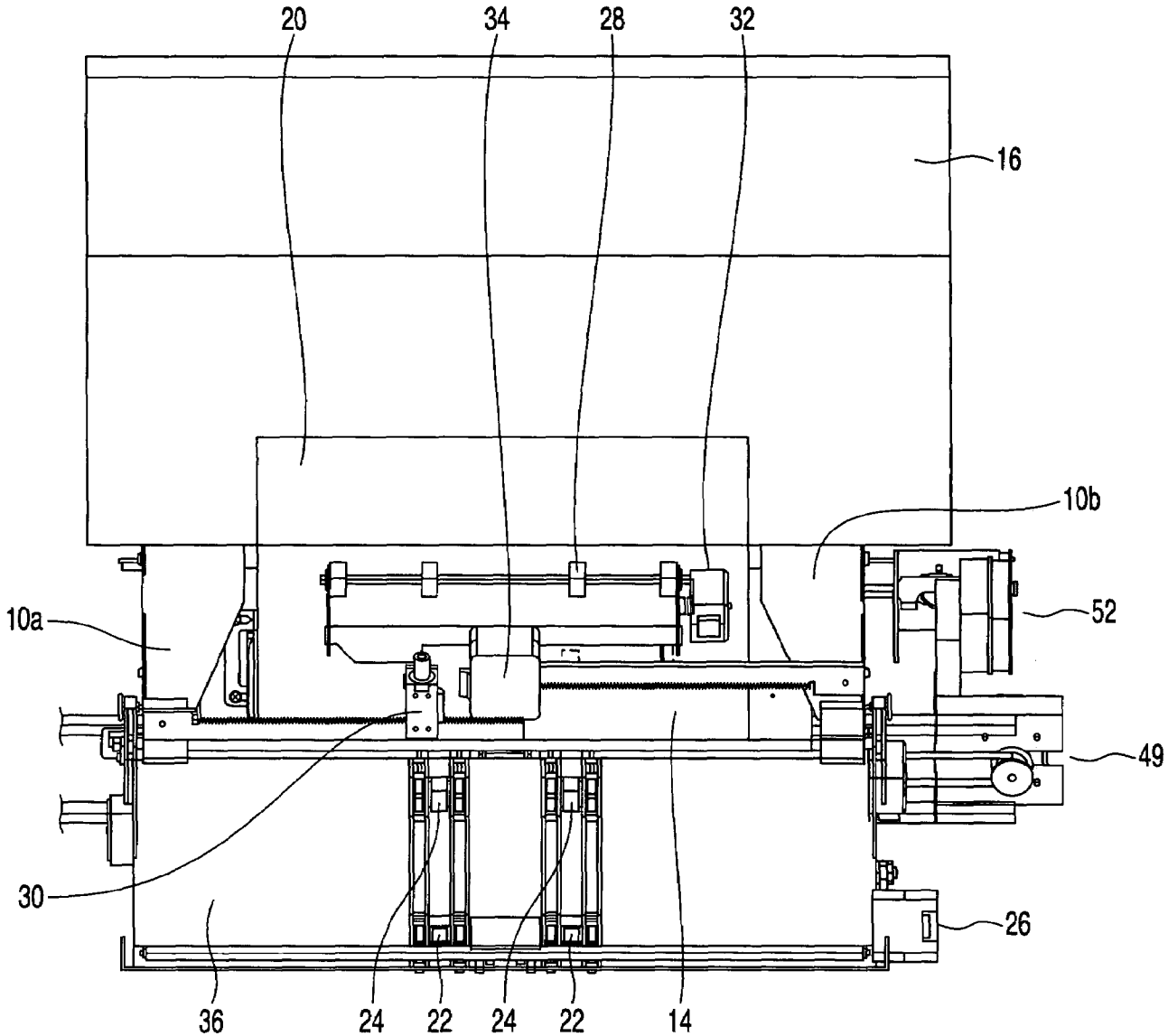
FIG. 2 is a top view of the post-process apparatus showing one embodiment of the invention.
Figure 3:
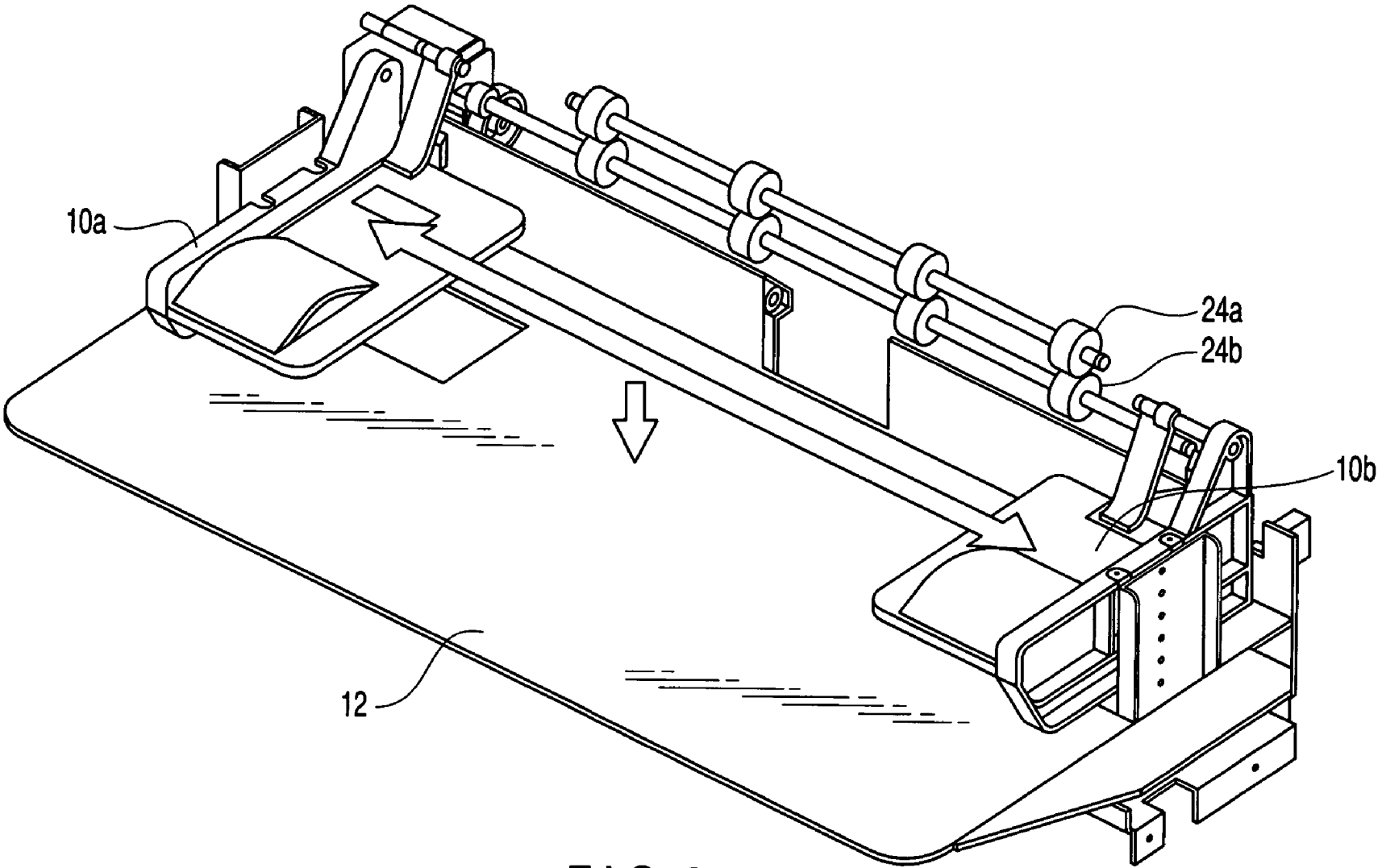
FIG. 3 is a view illustrating an operation of a waiting tray showing one embodiment of the invention.

The waiting tray will be described with reference to FIGS. 1, 2 and 3. As has been already described, when a preceding sheet is processed on the processing tray, a next sheet cannot be transported on the processing tray. The waiting tray is intended for make the next sheet standby in this state. The inlet roller 22 includes an upper inlet roller 22*a* and a lower inlet roller 22*b*. These rollers are driven by an inlet roller motor 26. The paper feed roller 24 includes an upper paper feed roller 24*a* and a lower paper feed roller 24*b*. These rollers are driven by a paper feed roller motor. The waiting tray roller 28 can be operated to be vertically elevated. This operation is controlled by a waiting tray roller drive source 30. The waiting tray roller 28 enables normal and invert rotation. This normal and invert rotation is carried out by a waiting tray roller motor 32.

On the waiting tray 10, left and right lower face support members 10*a* and 10*b* for supporting both sides of the lower face of a sheet carried into the waiting tray are provided in the left and right widthwise direction. A space between the left and right lower face support members is open. Therefore, a center portion of the sheet lower face is not supported. The upper faces of these left and right lower face support members 10*a* and 10*b* each are formed in a flat shape, and a curved face which is upwardly curved is formed at its top end side. Instead of this curved face or together with the curved face, a roller which is rotatable in an arbitrary direction may be engaged. The left and right lower face support members 10*a* and 10*b* are formed in the same width from the proximal end side to the distal end side. The width used here denotes a transverse direction in the case where the sheet transport direction is defined as a longitudinal direction. The left and right lower face support members 10*a* and 10*b* are set in a location in which a sheet side face can be supported fully on the left and right lower face support members at a first position. At a second position, these support members are set in a location in which the support of the sheet is released. The left and right lower face support members 10*a* and 10*b* are driven by the support member opening and closing motor (refer to FIG. 19). By this support member opening and closing motor, the left and right lower face support members are slid to adjust an opening width of an opening, and the left and right lower face support members 10*a* and 10*b* are moved to either of the first and second positions.

The waiting tray roller 28 returns the sheet transported to the waiting tray to the distal end side, and aligns the sheet distal end by abutting the sheet distal end against a distal end 60 of the waiting tray. In this case, although the sheets are located upwardly when they are transported to the waiting tray, the roller is lowered in the case where the sheet distal end is aligned. Then, the sheets are rotated while the sheets are compressed, and the sheets are pushed back. In addition, in the case where the sheets are transported from the waiting tray directly to the storage tray, the waiting roller is lowered and is rotated while the sheets are compressed, and the sheets are ejected. In this case, the rotation direction of the waiting tray roller 28 becomes inverted from that in the case where the sheets are abutted against the distal end side.

<Mechanism Corresponding to a Sheet of Large Size: Extensible Tray>

Figure 20:
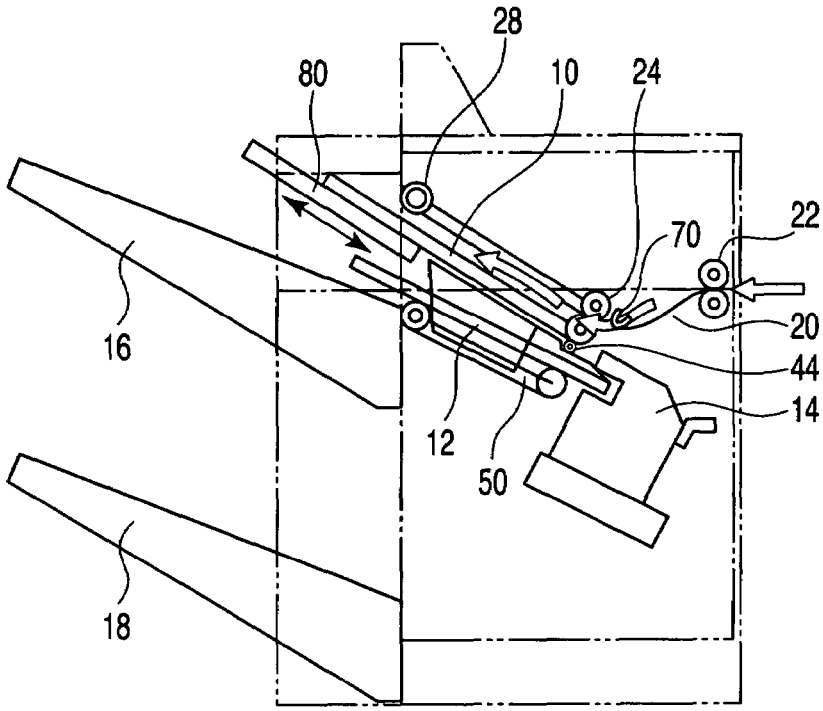
FIG. 20 is a view illustrating a waiting tray having an extensible tray showing one embodiment of the present invention.
Figure 21:
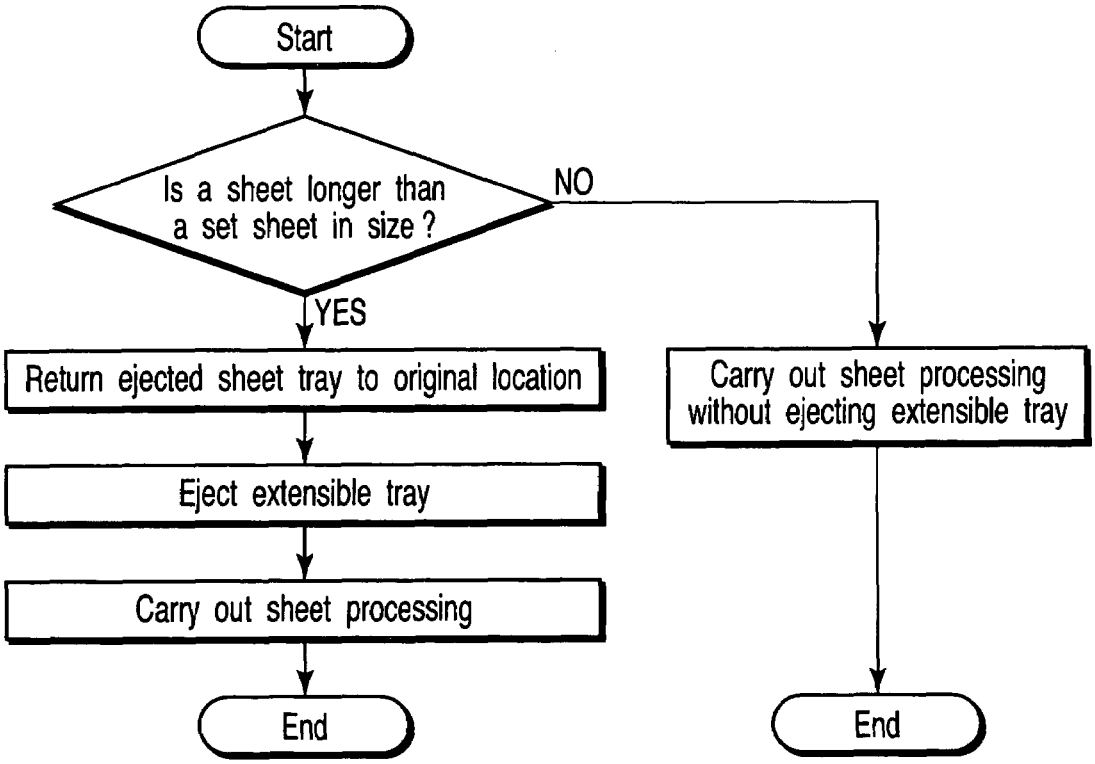
FIG. 21 is a flow chart of the waiting tray showing one embodiment of the invention.

Now, an extensible tray 80 of a waiting tray will be described with reference to FIGS. 20 and 21. The extensible tray 80 has a shape and a sheet support width which are similar to those of the left and right support members 10*a* and 10*b*. When a sheet of size set on the waiting tray (for example, A4 sheet) or a sheet of size which is smaller than the set size is carried, the extensible tray 80 is housed at the inside or the outside of the left and right lower face support members 10*a* and 10*b*. Then, the extensible tray 80 is driven to be opened or closed integrally with the left and right lower face support members 10*a* and 10*b*. Therefore, when the extensible tray 80 is housed in the left and right lower face support members 10*a* and 10*b*, a function specific to the extensile tray 80 does not work. A mechanism for extending or retracting the extensible tray can be arbitrarily selected by one skilled in the art. For example, a guide is formed on a contact face of the lower face support members 10*a* and 10*b* with the extensible tray 80, and a ring is allocated there. Then, a guide is formed on a contact face of the extensible tray 80 with the lower face support member 10*a* and 10*b* corresponding to the above contact face, whereby the extensible tray can be moved to be slid along the lower face support members 10*a* and 10*b*.

On the waiting tray, when a sheet of size exceeding a sheet set on the waiting tray (for example, A3 sheet) is carried, the extensible tray 80 is extended toward a distal end in a transport direction of a sheet to be transported to the waiting tray. The extension of the extensible tray 80 is carried out by an extensible tray drive motor (refer to FIG. 19 or the like) provided between the extensible tray 80 and each of the left and right lower face support members 10*a* and 10*b*. When processing of the sheet of size exceeding the sheet of size set on the waiting tray terminates, the extensible tray 80 returns to a housed state by the extensible tray drive motor.

On the waiting tray, there is provided the sheet sensor 70 (refer to FIG. 18 or the like) for sensing a sheet in the vicinity of the paper feed roller 24, i.e., on a side (upstream side) on which the sheet is carried into the waiting tray. This sheet sensor 70 senses the start of transport (sheet proximal end) and the end of transport (sheet distal end) by the paper feed roller 24, and sends this sense signal to control means (refer to FIG. 19).

<Control System>

Figure 19:
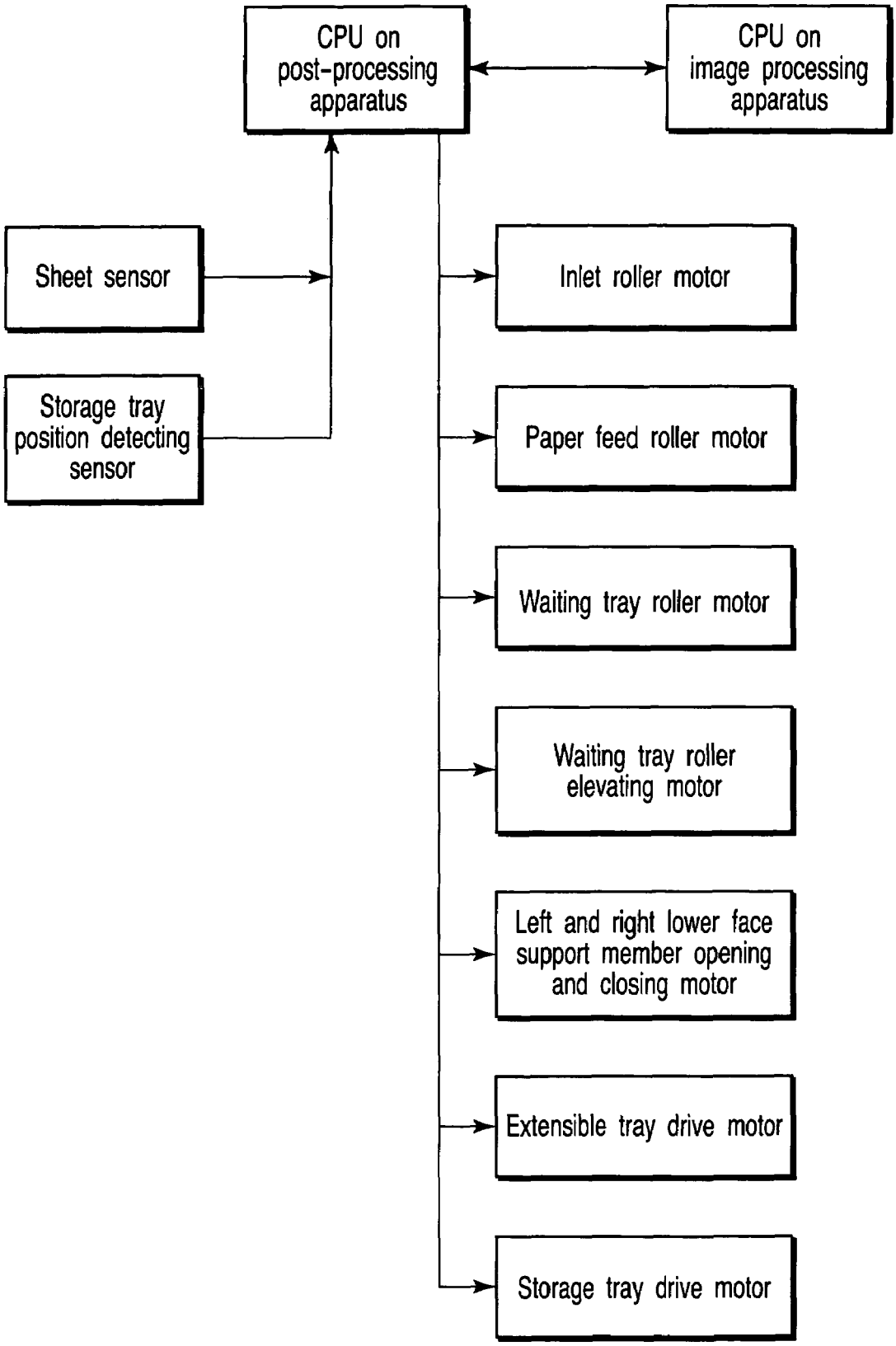
FIG. 19 is a view showing a control system of a waiting tray showing one embodiment of the present invention.

A control system is shown in FIG. 19. A CPU (control means) at the post-process apparatus side receives information such as, for example, the presence or absence of staple processing, how to carry out staple processing, the number of copies, and size of sheet to be copied, from a CPU (control means) at the image processing apparatus side. From these items of information, it is sensed whether or not the extensible tray should be extended. A detection signal indicating that a sheet distal end has been transported to the standby roller 10 is inputted from the sheet sensor to the CPU on the post-process apparatus side. The CPU at the post-process apparatus side determines an extension timing and an extension quantity of the extensible tray 80 based on these items of information and the above signal, and issues an output signal to the extension tray drive roller. In addition, a signal from sheet thickness sensing means for sensing the thickness of sheets held on the waiting tray is inputted to the CPU at the post-process apparatus side, and, based on this signal, the extension quantity is adjusted.

Further, the control means of the post-process apparatus receives information from the control means of the image processing apparatus, and senses whether the sheet to be transported to the waiting tray is provided as a sheet which should be retained on the waiting tray in a waiting mode or a sheet which is not required to be retained in a waiting mode. For example, based on information indicating how to carry out staple processing, this control means senses that the first sheet and second sheet are provided as sheets to be retained on the waiting tray in a waiting mode and the third and subsequent sheets are provided as sheets which are not required to be retained in a waiting mode. Alternatively, the control means senses that retention on the waiting tray in a waiting mode is not required from the information indicating that no staple processing is carried out. Further, the control means receives a signal from the sheet sensor 70 and senses a transported state of the sheet to the waiting tray 10. Then, the control means of the post-process apparatus instructs the drive motor of the lower face support members 10*a* and 10*b* to output a control signal indicating a release timing or a release quantity (release width) of the left and right lower face support members 10*a* and 10*b*, thereby properly dropping a sheet onto the processing tray 12 with a proper timing.

On the other hand, in the case where the sheet transported to the waiting tray is provided as a sheet which is not required to be retained on the waiting tray in a waiting mode, the left and right lower face support members 10*a* and 10*b* are released. As a result, the sheet is dropped onto the processing tray without passing the waiting tray.

When the sheet transported to the waiting tray exceeds the size of the set sheet, it is verified whether or not the storage tray is set in a predetermined location. When the tray is not set in its predetermined original location, the storage tray is returned to its predetermined original location by the storage tray drive motor. Then, as described above, the extensible tray motor is driven to extend the extensible tray.

<Processing Tray>

The processing tray carries out longitudinal and transverse alignments with respect to bundles of sheets dropped from the waiting tray and carries out predetermined processing (for example, staple processing). This processing tray is allocated in an inclined shape which is high at its proximal end side and which is low in its distal end side.

Figure 4:
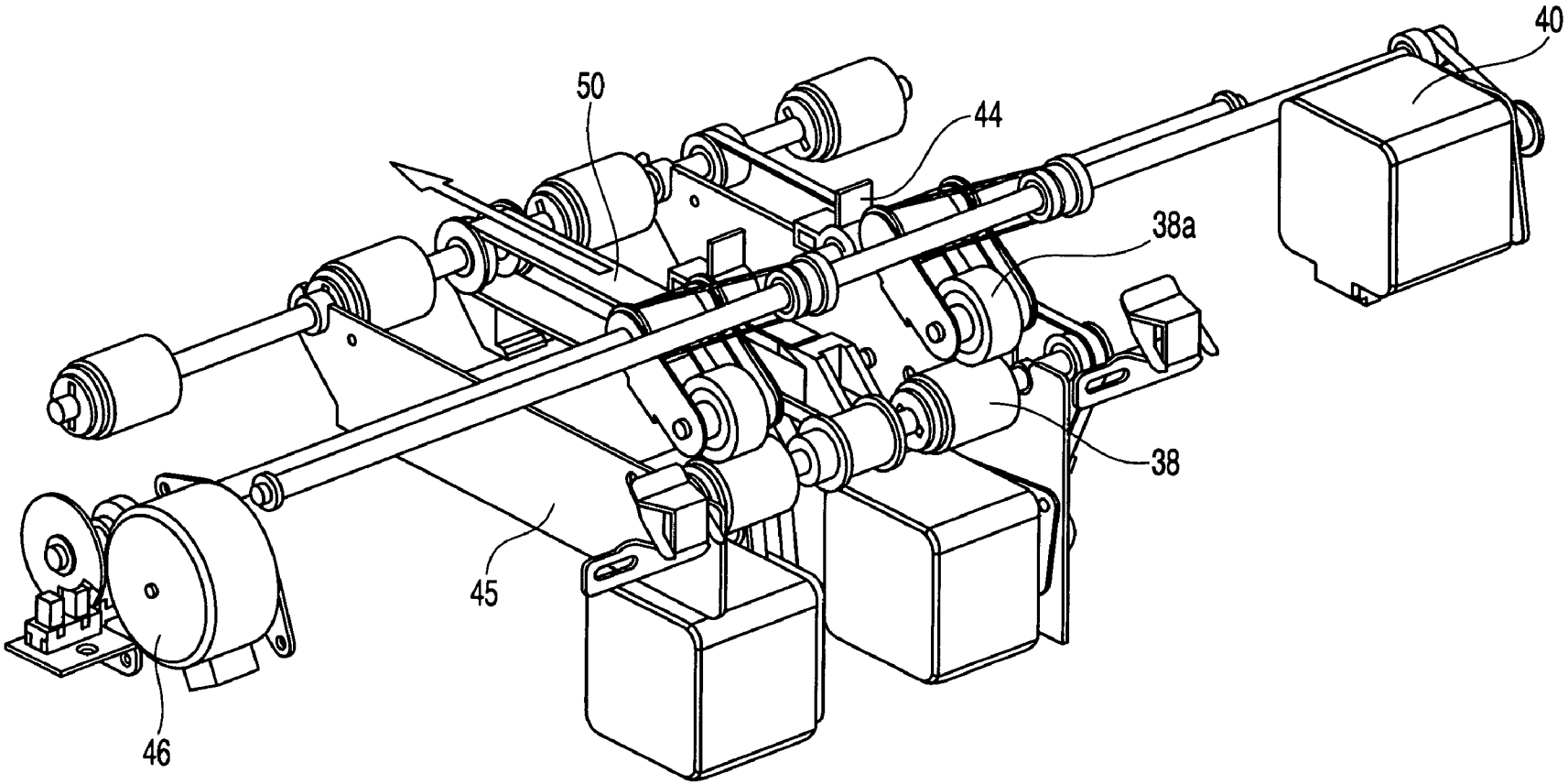
FIG. 4 is a view illustrating a longitudinal alignment and sheet bundle transport mechanism of the post-process apparatus showing one embodiment of the invention.

As shown in FIG. 4, longitudinal alignment is carried out by a longitudinal alignment roller 38. A longitudinal alignment upper roller 38*a* is driven by a longitudinal alignment upper roller motor 40, and a longitudinal alignment lower roller 38*b* is driven by a longitudinal alignment lower roller motor 42 to align sheets while a stopper 45 is defined as a reference. In addition, in order to assist this alignment, a paddle 44 is provided. This paddle 44 is driven by a paddle motor 46.

Figure 5:
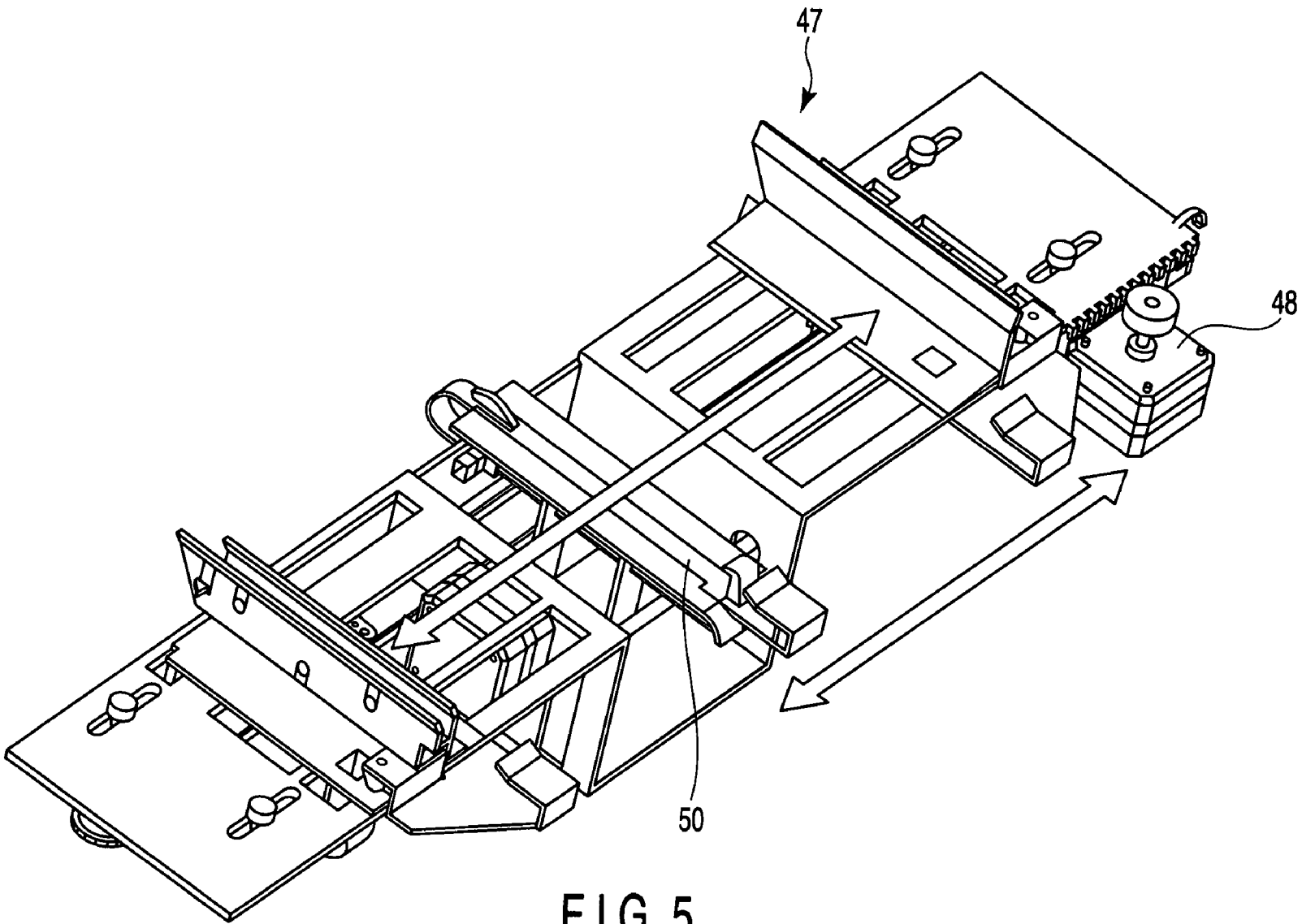
FIG. 5 is a view illustrating a transverse alignment mechanism of the post-process apparatus showing one embodiment of the invention.

As shown in FIG. 5, transverse alignment is executed by a transverse alignment mechanism 47 and a transverse alignment motor 48.

When a predetermined number of sheets are aligned and stacked on the processing tray 12, staple processing is carried out by the stapler 14.

Figure 6:
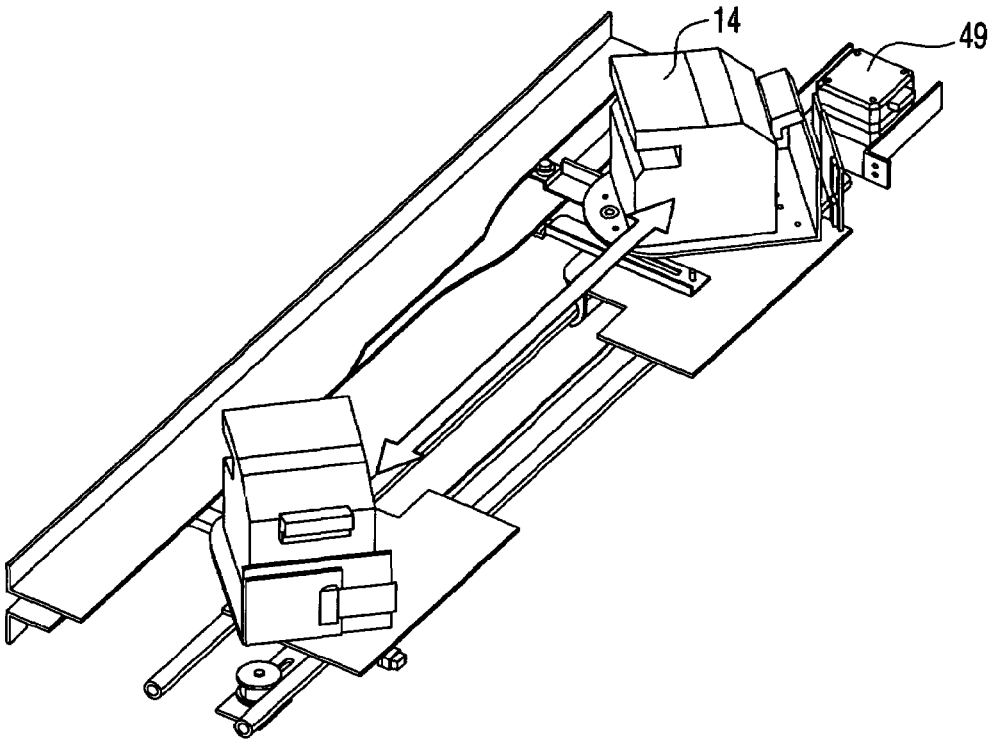
FIG. 6 is a view illustrating an operation of a stapler of the post-process apparatus showing one embodiment of the invention.
Figure 7:
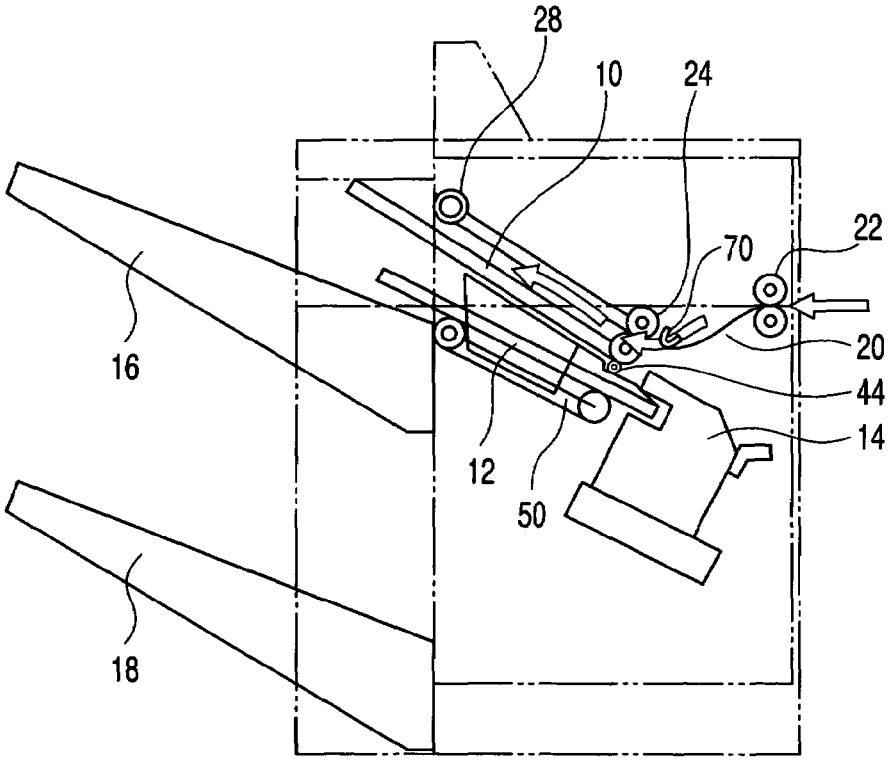
FIG. 7 is a view illustrating a flow of a first sheet of sheets between an inlet roller and a paper feed roller in the post-process apparatus showing one embodiment of the invention.
Figure 8:
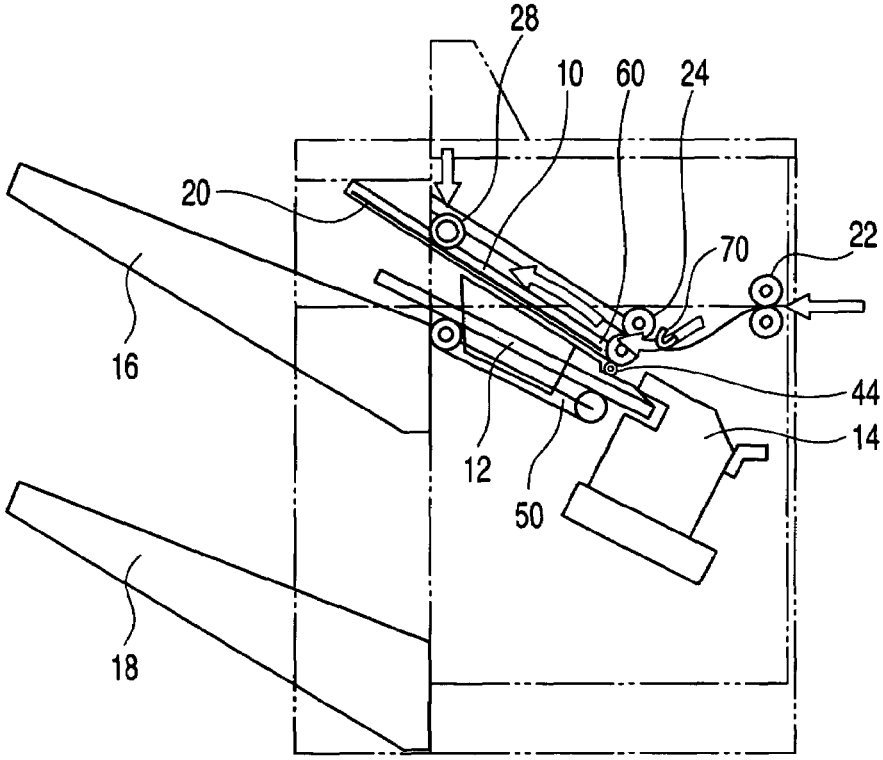
FIG. 8 is a view illustrating a flow of a first sheet of sheets between the paper feed roller and a standby roller in the post-process apparatus showing one embodiment of the invention.
Figure 9:
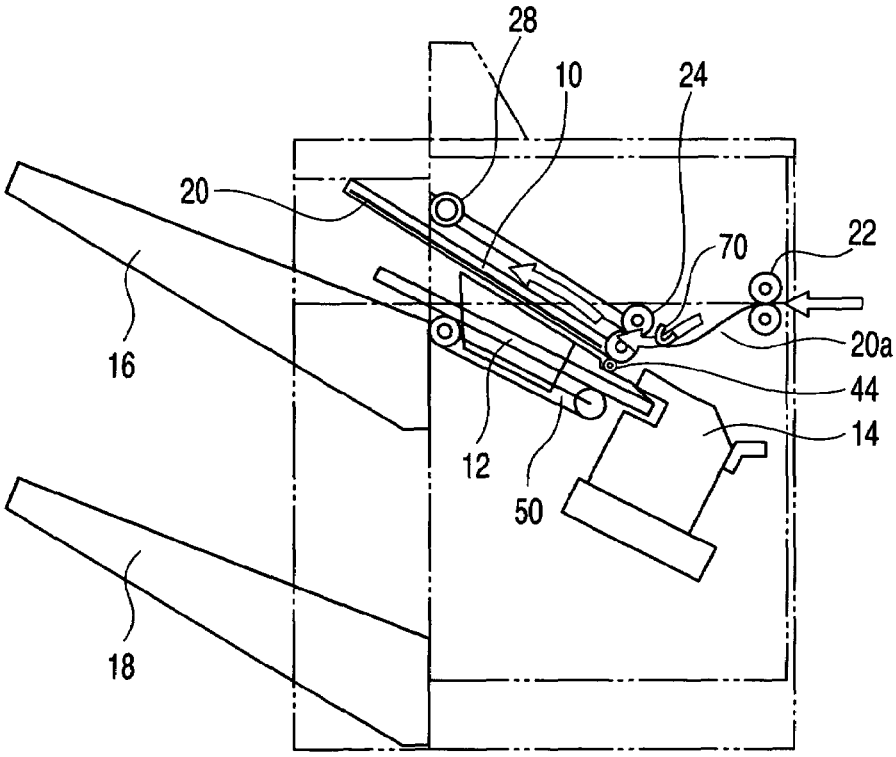
FIG. 9 is a view illustrating a flow of a second sheet of sheets between the paper feed roller and the standby roller in the post-process apparatus showing one embodiment of the invention.
Figure 10:
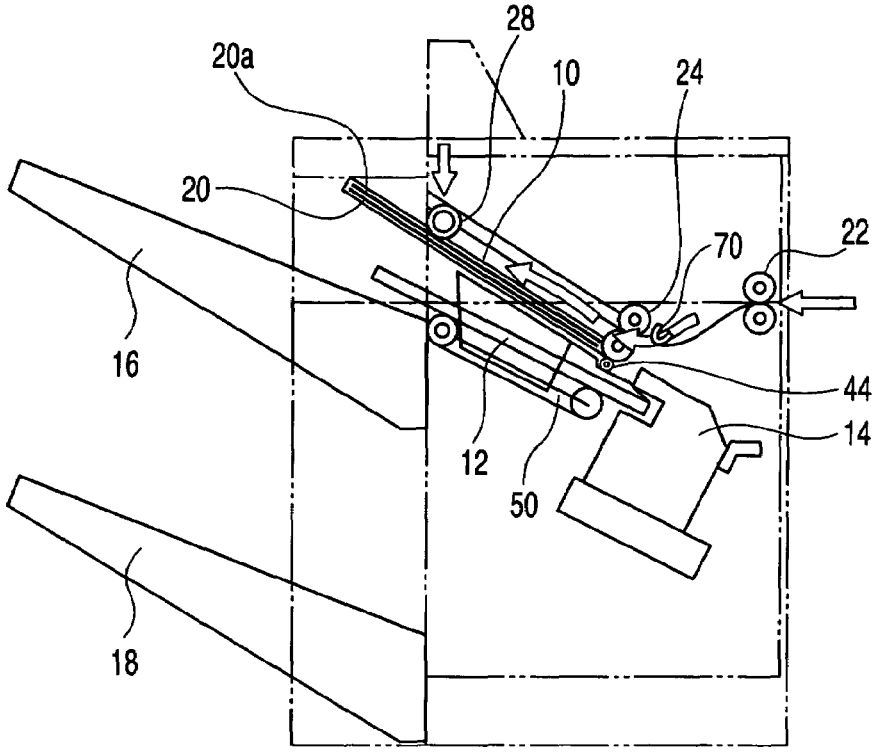
FIG. 10 is a view illustrating an operation of a waiting tray roller in the post-process apparatus showing one embodiment of the invention.

As shown in FIG. 6, the stapler 14 is positioned by a staple drive unit 49, and staple processing is controlled.

<Storage Tray>

As shown in FIG. 4, the staple processed bundles of sheets are sent to the storage tray 16 by a transport mechanism 50. Selection of the storage tray 16 or 18 is made by vertically moving the storage tray 16 or 18 by a storage tray drive unit 52.

In the case where sheets are directly ejected from the waiting tray 10, the storage tray is risen up to a location which corresponds to a sheet outlet of the waiting tray.

(Description of Operation)

Now, an operation of the post-process apparatus according to the present invention will be described with reference to FIGS. 7 to 18.

<Operation in Case Where Staple Processing is Carried Out>

As has been already described, staple processing on the processing tray is slow as compared with that on the image processing apparatus. Thus, when a sheet transported from the image processing apparatus is processed on the processing tray, a buffer unit is provided at the front stage thereof. Then, it is necessary to a next sheet standby not so as to be transported to the processing tray until the staple processing on the processing tray has completed. In this example, a description will be given with respect to a case in which two sheets (first and second sheets) are made standby on the waiting tray, and the third and subsequent sheets are not required to be made standby.

A first sheet from the image processing apparatus is transported to the waiting tray 10 via the inlet roller 22 and the paper feed roller 24. The sheet is retained by the left and right lower face support members 10*a* and 10*b* and the distal end support member which are set at a first position; the waiting tray roller 28 is lowered, and the sheet distal end is aligned (this alignment is made with a distal end 60 of the waiting tray 10 (upstream side)).

Figure 11:
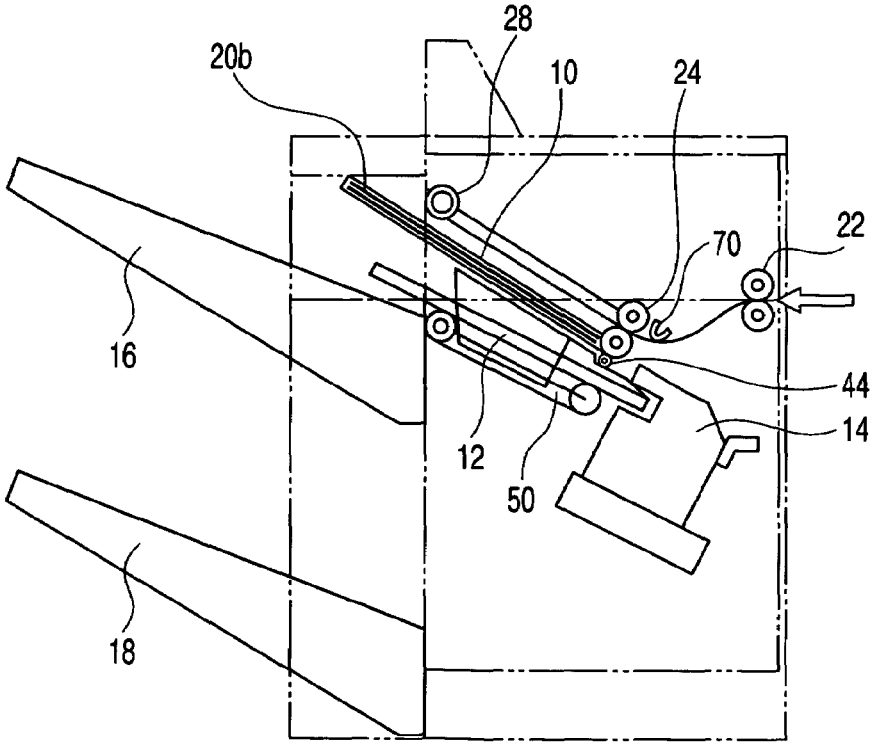
FIG. 11 is a view illustrating an operation of the waiting tray roller in the post-process apparatus showing one embodiment of the invention.
Figure 12:
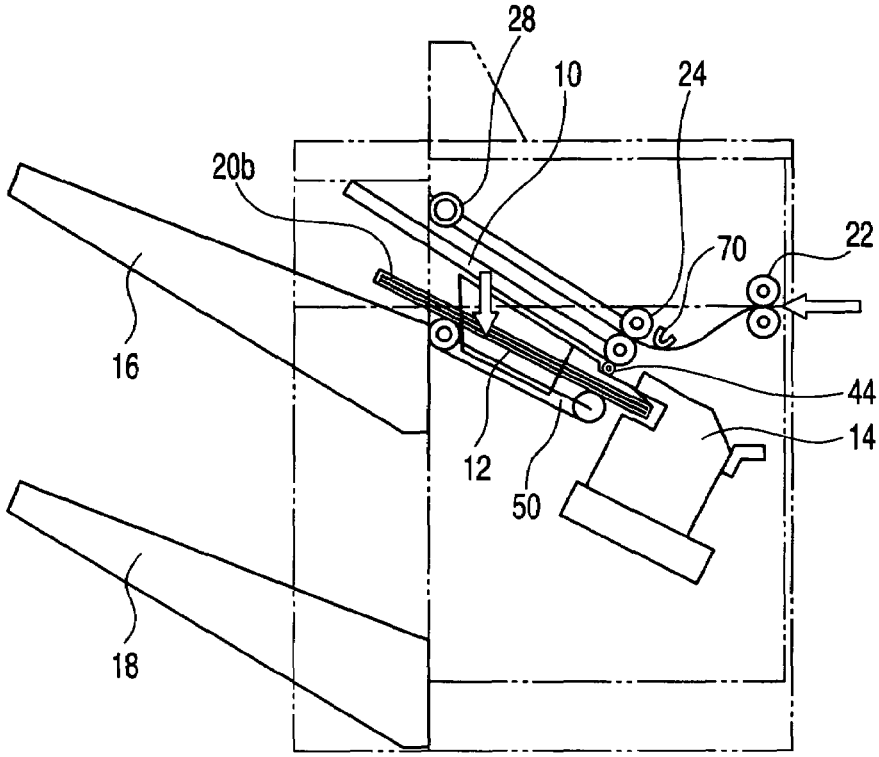
FIG. 12 is a view illustrating an operation of an active drop in the post-process apparatus showing one embodiment of the invention.

Next, the waiting tray roller 28 is risen, and is ready for accepting a second sheet 20*a*. When the second sheet 20*a* is sent to the waiting tray 10, the waiting tray roller 28 is lowered to align a location of the sheet with the distal end 60 of the waiting tray 10. Then, the waiting tray roller 28 is risen (FIG. 11). When the second sheet is transported to the waiting tray, the distal end portion of the sheet is sensed by the sheet sensor 70. Based on this sense signal, the first and second sheets are dropped onto the processing tray 12 altogether. That is, the left and right lower face support members 10*a* and 10*b* are released to be located at a second position or a third position so as to release support of both sides of the sheet.

Then, with respect to the third and subsequent sheets, the waiting tray is kept in a state in which the support of the sheet is released, and the sheet is transported from the paper feed roller 24 directly to the waiting tray.

Figure 13:
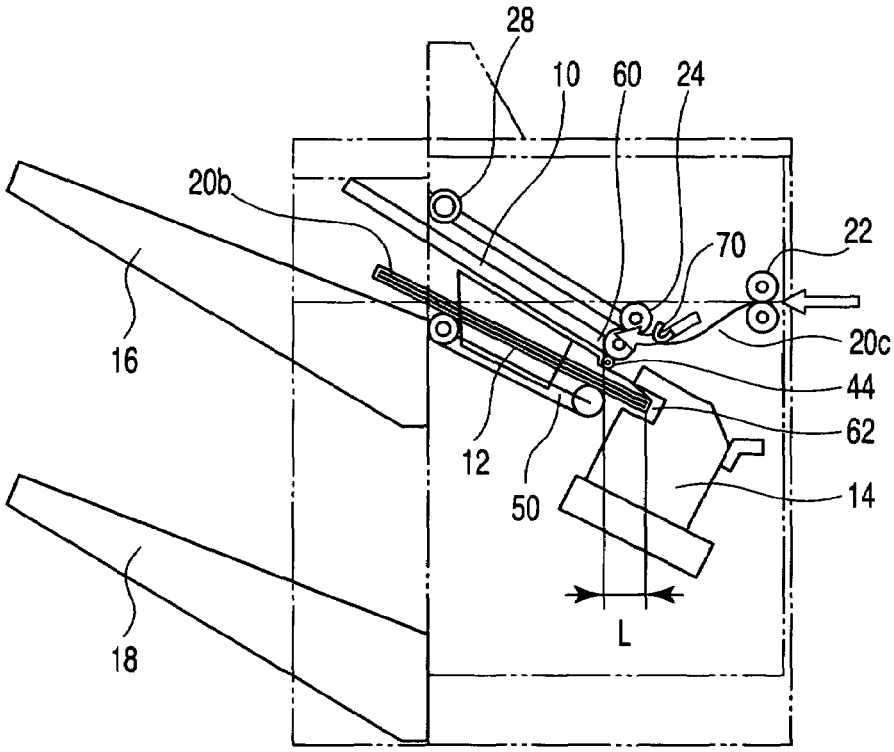
FIG. 13 is a view illustrating a flow of a third sheet of sheets in the post-process apparatus showing one embodiment of the invention.

A state in which the second sheet is held on the processing tray 12 will be first described. In the processing tray 12, a predetermined number of bundles of sheets 21 are formed to be held on two bundles of sheets 20*b*. At this time, the longitudinal and transverse alignment mechanisms 38 and 47 function, and longitudinal and transverse sheet alignments are executed. At this time, as shown in FIG. 13, the distal end 60 of the waiting tray 10 and a distal end (upstream side) 62 of the processing tray 12 are spaced in a transverse direction with a distance L so that the distal end 60 of the waiting tray 10 exists on the downstream side more than the distal end 62 of the processing tray 12. With such a construction, the bundle of sheets 20*b* can be easily dropped from the waiting tray 10 to the processing tray 12, and an aligning operation using the longitudinal and transverse alignment mechanisms 38 and 47 can be easily made. As a result, an occurrence of jamming can be prevented.

The processing tray 12 is allocated to be obliquely inclined together with the waiting tray 10. Thus, the distal ends 60 and 62 of the respective trays are located at the lowest position, and the sheet 20 and the bundle of sheets 21 can be aligned with the distal ends 60 and 62 by its own weight of the sheet 20 and the bundle of sheets 21.

Figure 14:
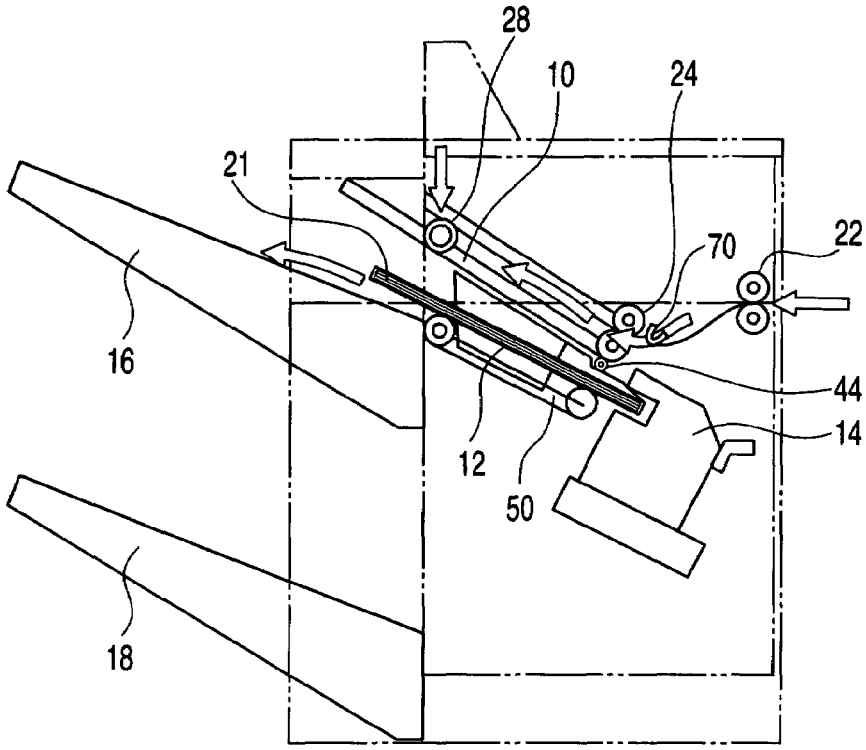
FIG. 14 is a view illustrating an operation of a stapler in the post-process apparatus showing one embodiment of the invention.
Figure 15:
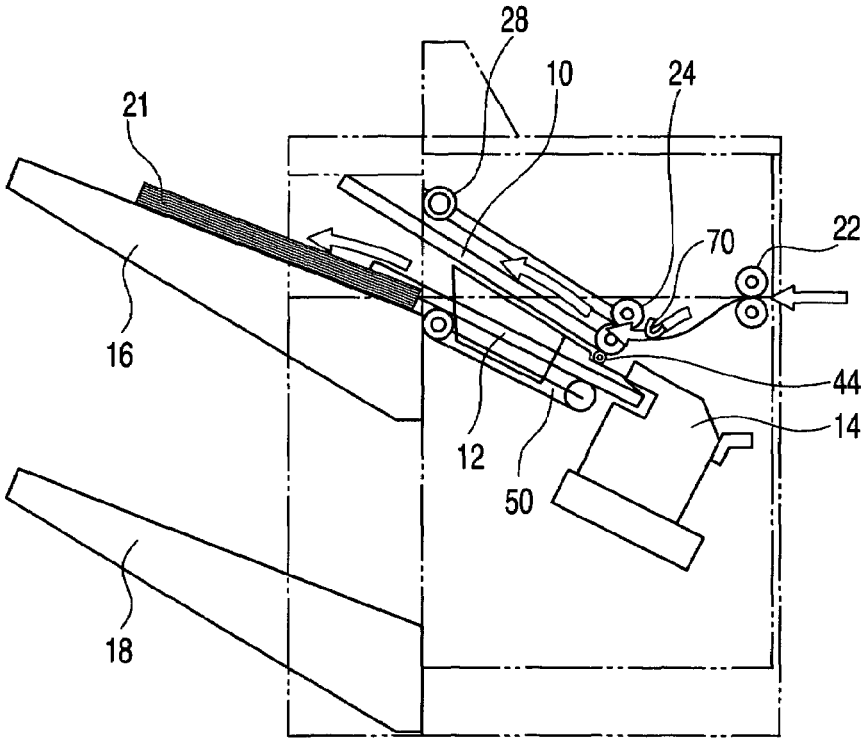
FIG. 15 is a view illustrating a flow of a bundle of sheets between a processing tray and a storage tray in the post-process apparatus showing one embodiment of the invention.

Next, as shown in FIG. 14, the bundle of sheets 21 is staple processed by the stapler 14. Then, as shown in FIG. 15, the bundle of sheets 20 is fed to the storage tray 16 by the transport mechanism 50, and post-process terminates.

<Operation in Case Where No Post-Process is Carried Out>

Figure 16:
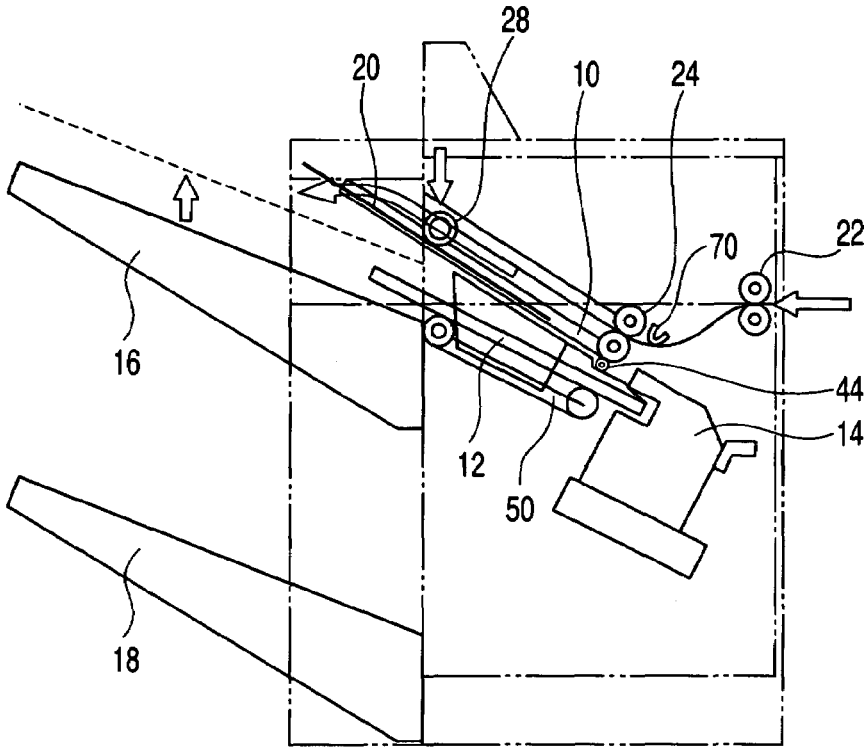
FIG. 16 is a view illustrating a flow of direct sheet ejection of a sheet from the waiting tray to the storage tray in the post-process apparatus showing one embodiment of the invention.
Figure 17:
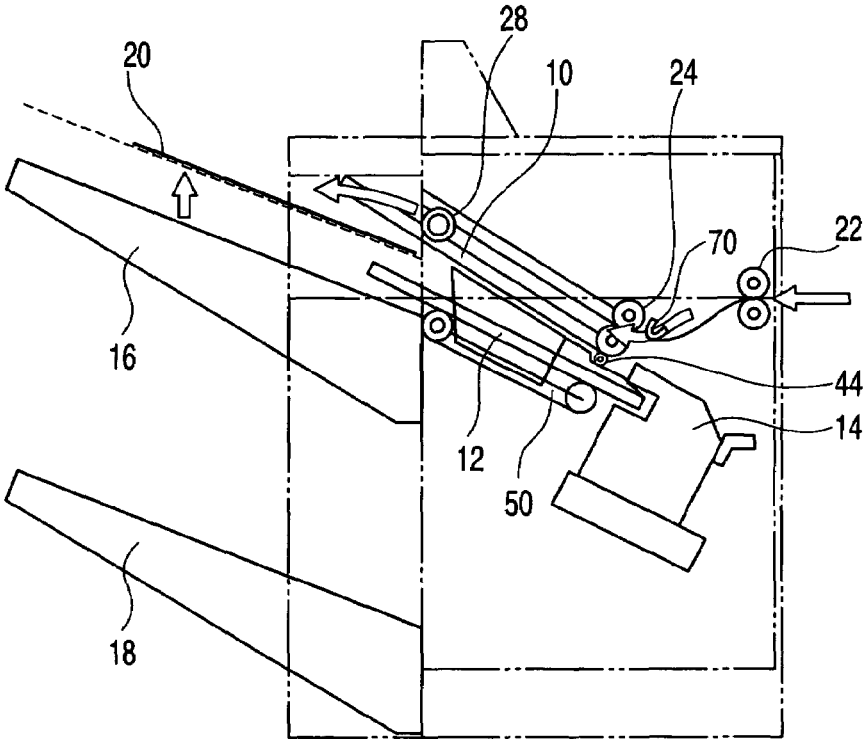
FIG. 17 is a view illustrating an operation of a position change of the storage tray in the post-process apparatus showing one embodiment of the invention.

In the case where no post-process is carried out (such as a case in which no staple processing is carried out or a case in which jamming occurs), as shown in FIGS. 16 and 17, a sheet is ejected from the waiting tray 10 directly to the storage tray 16 without intervening the processing tray 12. As shown in FIG. 16, the sheet fed from the image processing apparatus is fed to the storage tray 16 via the inlet roller 22, the paper feed roller 24, and the waiting tray 10. The waiting tray roller 28 is lowered, and carries out transportation of the sheet 20. The storage tray 16, as shown in FIG. 17, is slightly risen by a storage tray drive unit 52 to receive the sheet fed from the waiting tray 10.

<Case in Which Sheet is Longer Than Setting>

When a sheet of size longer than a sheet set on the waiting tray 10 (for example, A4 size) is transported, an extensible tray drive motor is actuated, and the extensible tray 80 is extended to a proximal end side in a sheet transport direction. In this manner, even a sheet of long size can be stably retained on the waiting tray in a waiting mode. In this case, the extension quantity is adjusted in association with the thickness (height) of sheets. Information concerning sheet thickness is obtained from information (such as ordinary sheet or cardboard or the like) concerning thickness of one sheet sent from the control circuit of the image processing apparatus and the number of sheets held on the waiting tray. In addition, extension of the extensible tray is carried out after it has been verified that the storage tray 16 is set in a location which does not interfere with the extension of the extensible tray. The subsequent operation is identical to that in the case where a predetermined sheet is transported. Therefore, a duplicate description is omitted here. When processing of a sheet of size longer than the set sheet terminates, the extensible tray is housed in its original location.

Although embodiments of the present invention have been described above, the present invention is not limited to the embodiments. Constituent elements shown in the embodiments can be changed to other constituent elements as long as they have the same functions.

What is claimed is:

1. A sheet post-process apparatus, the apparatus comprising:

a waiting tray which temporarily retains a transported sheet, and releases the retention to drop the sheet;

a processing tray which bundles sheets dropped from the waiting tray to carry out predetermined processing, and ejects the sheets, wherein the waiting tray makes a next sheet standby, so as not to be transported to the processing tray, until the predetermined processing of a preceding sheet on the processing tray has been completed;

a storage tray which holds the bundle of sheets processed and ejected on the processing tray, wherein the waiting tray comprises:

left and right lower face support members which support left and right lower faces in a sheet transport direction during retention and release the support of the left and right lower faces during release of the retention;

an extensible tray coupled to the left and right lower face support members, the extensible tray being projectively provided in a proximal end direction of the transported sheet, and remaining in a projected position after sheets have been dropped from the waiting tray;

drive means for projecting the extensible tray in a transport distal end direction of the sheet; and control means for controlling the drive means, and the control means controls the drive means to project the extensible tray in the transport proximal end direction of the sheet when it is sensed that a size of a sheet transported to the waiting tray exceeds a size set on the waiting tray, based on information concerning a size of the sheet transported to the waiting tray; and sensor means for sensing height of sheets held on the waiting tray, wherein the control means controls the drive means to adjust a projection length of the extensible tray, based on the height of sheets sensed by the sensor means.

2. A sheet post-process apparatus according to claim 1, wherein the waiting tray is allocated to be proximal to an upper stage of the processing tray, the processing tray and the waiting tray are allocated in an inclined shape which is high at from a proximal end side of the sheet to be transported and which is low at to a distal end side thereof, the processing tray and the waiting tray are shorter in length of a sheet transport direction thereof than a length of a standard sheet to be held, and a part of the proximal end side in the transport direction of the sheet held on the processing tray is held on the storage tray.

3. A waiting tray for use in a sheet post-process apparatus, for temporarily retaining a transported sheet in a waiting mode, followed by releasing the support, making it possible to drop the sheet on a processing tray, the waiting tray comprising:

left and right lower face support members which support left and right lower faces in a sheet transport direction during retention and release the support of the left and right lower faces during release of the retention, wherein the left and right lower face support members make a next transported sheet standby, so as not to be transported to the processing tray, until a predetermined processing of a preceding sheet on the processing tray has been completed; and an extensible tray coupled to the left and right lower face support members, the extensible tray being projectively provided on a proximal end direction of the transported sheet, and remaining in a projected position after sheets have been dropped from the waiting tray, wherein the extensible tray is projected in the proximal end direction of the sheet when a size of a sheet transported to the waiting tray exceeds a size set on the waiting tray.

4. A sheet post-process apparatus, the apparatus comprising:

waiting means for temporarily retaining a transported sheet, and releasing the retention to drop the sheet;

processing means for bundling sheets dropped from the waiting means to carry out predetermined processing, and ejecting the sheets, wherein the waiting means makes a next transported sheet standby, so as not to be transported to the processing means, until the predetermined processing of a preceding sheet on the processing means has been completed;

storage means for holding the bundle of sheets processed and ejected by the processing means, wherein the waiting means comprises:

left and right lower face support means for supporting left and right lower faces in a sheet transport direction during retention mode and releasing the support of the left and right lower faces during release of the retention;

extensible means coupled to the left and right lower face support means, the extensible means being projectively provided in a proximal end direction of the transported sheet, and remaining in a projected position after sheets have been dropped from the waiting tray;

drive means for projecting the extensible means in a transport distal end direction of the sheet; and control means for controlling the drive means, and the control means controls the drive means to project the extensible tray in the transport proximal end direction of the sheet when it is sensed that a size of the sheet transported to the waiting tray exceeds a size set on the waiting means, based on information concerning a size of the sheet transported to the waiting tray; and sensor means for sensing height of sheets held on the waiting means, wherein the control means controls the drive means to adjust a projection length of the extensible means, based on the height of sheets sensed by the sensor means.

* * * * *